US010011383B2

(12) United States Patent
Suolahti et al.

(10) Patent No.: US 10,011,383 B2
(45) Date of Patent: Jul. 3, 2018

(54) METHOD FOR CONVERTING A WRAPPING MACHINE INTO A TRANSPORT CONDITION, AND A WRAPPING MACHINE

(71) Applicant: Signode Industrial Group LLC, Glenview, IL (US)

(72) Inventors: Yrjo Suolahti, Mynamaki (FI); Janne Koskela, Turku (FI)

(73) Assignee: Signode Industrial Group LLC, Glenview, IL (US)

( * ) Notice: Subject to any disclaimer, the term of this patent is extended or adjusted under 35 U.S.C. 154(b) by 594 days.

(21) Appl. No.: 14/346,931

(22) PCT Filed: Sep. 25, 2012

(86) PCT No.: PCT/US2012/057067

§ 371 (c)(1),
(2) Date: Mar. 24, 2014

(87) PCT Pub. No.: WO2013/049034

PCT Pub. Date: Apr. 4, 2013

(65) Prior Publication Data

US 2014/0250831 A1 Sep. 11, 2014

(30) Foreign Application Priority Data

Sep. 30, 2011 (FI) ..... 20115958

(51) Int. Cl.
*B65B 65/00* (2006.01)
*B65B 11/02* (2006.01)
(Continued)

(52) U.S. Cl.
CPC ..... *B65B 65/00* (2013.01); *B65B 11/025* (2013.01); *B65B 49/00* (2013.01); *B65B 59/04* (2013.01);
(Continued)

(58) Field of Classification Search
CPC ..... B65B 65/00; B65B 11/025; B65B 49/00; B65B 11/008; B65B 59/04
(Continued)

(56) References Cited

U.S. PATENT DOCUMENTS 2,711,803 A * 6/1955 Hurst ..... B66C 13/18 16/231
2,745,688 A * 5/1956 Farrington ..... E04B 1/38 248/291.1
(Continued)

FOREIGN PATENT DOCUMENTS

CN 101 830 292 9/2010
DE 2256753 5/1974
(Continued)

OTHER PUBLICATIONS

ISR for PCT/US2012/057067 dated Dec. 10, 2012.

*Primary Examiner* — Nathaniel Chukwurah
*Assistant Examiner* — Eduardo R Ferrero
(74) *Attorney, Agent, or Firm* — Neal, Gerber & Eisenberg LLP

(57) ABSTRACT

A method for converting a wrapping machine into a transport condition, said wrapping machine comprising a wrapping machine frame, as well as a circular guide mounted on the frame, whereby, in order to convert the wrapping machine into a transport condition, the circular guide mounted on the wrapping machine frame is tilted with respect to the wrapping machine frame. The invention relates also to such a wrapping machine.

18 Claims, 4 Drawing Sheets

Figure 1:
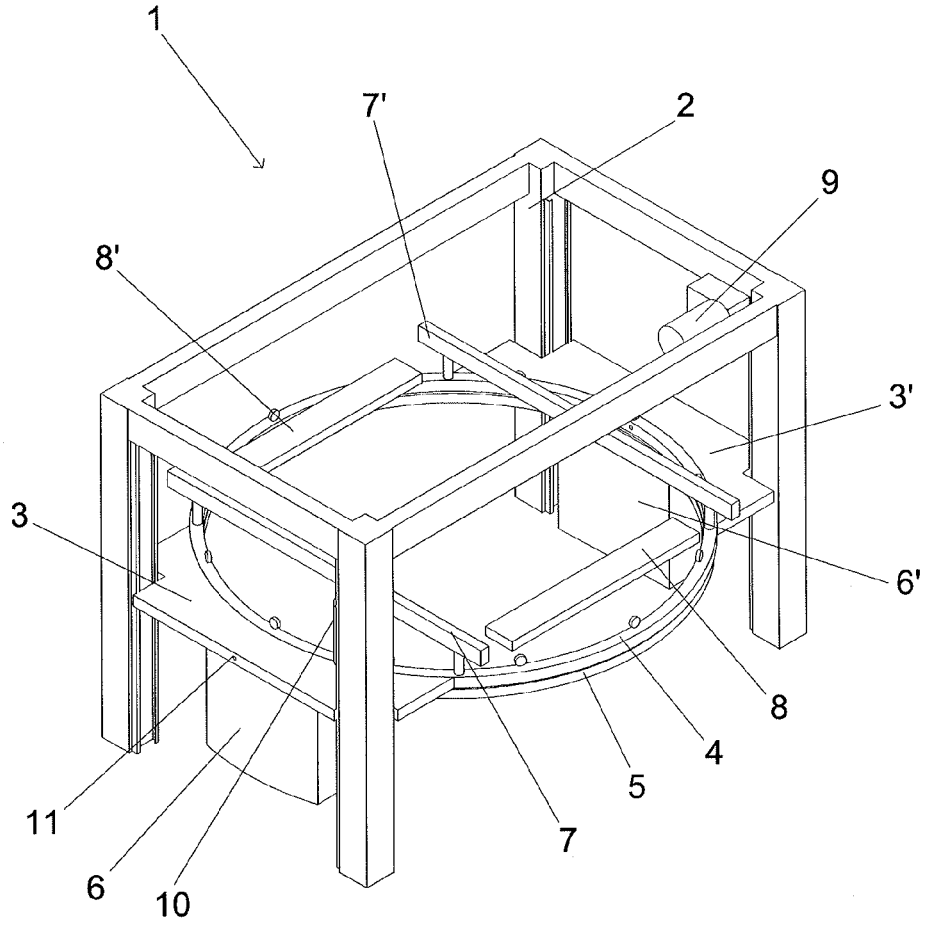

(51) Int. Cl.
*B65B 59/04* (2006.01)
*B65B 49/00* (2006.01)

(52) U.S. Cl.
CPC ..... *B65B 2210/18* (2013.01); *Y10T 29/49716* (2015.01)

(58) Field of Classification Search
USPC ..... 53/339, 588, 176, 211, 441; 403/83, 84, 403/92; 414/444, 791.5
See application file for complete search history.

(56) References Cited

U.S. PATENT DOCUMENTS 2,758,898 A * 8/1956 Kobsch ..... A47B 1/04 108/77
2,797,634 A * 7/1957 Rueckert ..... A22C 11/005 100/13
2,942,797 A * 6/1960 Lorenz ..... B21C 47/24 242/128
3,016,869 A * 1/1962 Anderson ..... B63H 20/08 440/56
3,190,457 A * 6/1965 Linden ..... B66C 23/344 212/296
3,278,059 A * 10/1966 Ridgeway ..... B60P 1/50 414/408
3,436,046 A * 4/1969 Valeska ..... A61G 15/14 211/100
3,507,137 A * 4/1970 Robinson ..... H01F 41/063 242/439.5
3,626,654 A 12/1971 Hoffler et al.
3,679,244 A * 7/1972 Reddy ..... F16B 2/24 403/109.3
3,852,937 A 12/1974 Bitsura et al.
3,902,303 A 9/1975 King
3,944,045 A 3/1976 Higgins
4,063,401 A 12/1977 Higgins
4,067,174 A 1/1978 Goldstein
4,204,377 A 5/1980 Lancaster et al.
4,235,062 A 11/1980 Lancaster, III et al.
4,317,322 A * 3/1982 Lancaster ..... B65B 11/008 100/13
4,473,990 A 10/1984 Thimon
4,587,796 A 5/1986 Haloila
4,588,142 A * 5/1986 Malzacher ..... B65H 54/2812 242/390.5
4,619,193 A * 10/1986 Crew ..... A01G 23/04 100/13
4,631,898 A 12/1986 Brambilla
4,754,594 A 7/1988 Lancaster
4,756,143 A 7/1988 Lancaster
4,905,448 A * 3/1990 Plitt ..... B65B 11/025 53/176
4,905,451 A 3/1990 Jaconelli et al.
4,914,891 A 4/1990 Suolahti
4,939,989 A * 7/1990 Zacharias ..... B65B 25/02 100/13
5,107,657 A 4/1992 Diehl et al.
5,140,795 A 8/1992 Steding
5,154,382 A * 10/1992 Hoshino ..... F16C 11/103 248/185.1
5,195,297 A 3/1993 Lancaster et al.
5,216,871 A 6/1993 Hannen
5,463,843 A 11/1995 Sharp
5,619,838 A 4/1997 Kasel
5,623,808 A * 4/1997 Franklin ..... B65B 11/025 53/399
6,032,439 A 3/2000 Birkenfeld et al.
6,237,307 B1 5/2001 Zentmyer et al.
6,298,636 B1 10/2001 Lachenmeier et al.
6,470,654 B1 10/2002 Lachenmeier et al.
6,516,591 B1 2/2003 Lancaster, III et al.
6,539,690 B2 4/2003 Alvarez
6,619,872 B2 * 9/2003 Crorey ..... B25J 15/0052 403/54
6,622,620 B1 * 9/2003 Byington ..... B65B 25/02 100/13
6,865,865 B2 3/2005 Hannen et al.
6,945,163 B2 * 9/2005 Squyres ..... B65B 25/02 100/13
7,036,289 B2 5/2006 Suolahti
7,040,076 B2 5/2006 Lachenmeier et al.
7,234,289 B2 6/2007 Hannen et al.
7,325,487 B2 * 2/2008 Squyres ..... B65B 25/02 100/13
7,367,740 B2 * 5/2008 Lazic ..... F16C 11/10 248/125.1
7,533,515 B1 * 5/2009 Koskela ..... B65B 11/025 100/27
7,707,801 B2 5/2010 Lancaster, III
7,707,802 B2 5/2010 Forrest
7,908,831 B1 3/2011 Dugan
7,913,476 B2 3/2011 Lachenmeier
7,937,910 B2 5/2011 Jaconelli et al.
7,966,790 B2 6/2011 Michels et al.
7,975,456 B2 7/2011 Lachenmeier et al.
8,141,327 B2 3/2012 Lancaster, III
8,347,784 B2 * 1/2013 Herrmann ..... A01G 23/04 100/13
8,453,420 B2 6/2013 Schmidt et al.
8,875,480 B2 11/2014 Czok
2001/0046409 A1 * 11/2001 Fischer ..... B60R 11/02 403/92
2002/0033005 A1 3/2002 Lachenmeier et al.
2003/0156891 A1 * 8/2003 Hung ..... F16C 11/10 403/84
2004/0107677 A1 6/2004 Hannen et al.
2006/0005511 A1 1/2006 Suolahti et al.
2006/0040085 A1 2/2006 Downs et al.
2006/0285915 A1 * 12/2006 Dellach ..... F16C 11/10 403/92
2007/0157557 A1 7/2007 Lancaster, III
2007/0163207 A1 7/2007 Chiu Chen
2009/0217624 A1 9/2009 Forrest
2009/0229226 A1 9/2009 Beeland et al.
2009/0293425 A1 12/2009 Carter et al.
2010/0018165 A1 1/2010 Kudia
2010/0071317 A1 3/2010 Michels et al.
2010/0163443 A1 7/2010 Storig et al.
2010/0258241 A1 10/2010 Perecman
2011/0258973 A1 10/2011 Czok et al.
2014/0013714 A1 1/2014 Lachenmeier et al.
2014/0053502 A1 2/2014 Pecchenini et al.

FOREIGN PATENT DOCUMENTS

DE 3101310 12/1981
DE 3918311 12/1989
DE 3914595 11/1990
DE 20101909 6/2002
DE 10 2005 037 916 5/2006
DE 10 2005 062 609 7/2007
DE 20 2007 018 900 8/2009
DE 10 2010 037 770 6/2012
DE 10 2011 000 205 7/2012
DE 10 2012 024 176 6/2014
EP 0 621 184 10/1994
EP 0 653 352 5/1995
EP 0811554 A1 12/1997
EP 1 033 305 9/2000
EP 1 097 867 5/2001
EP 1 266 828 12/2002
EP 1 266 829 12/2002
EP 1454827 A2 9/2004
EP 1 542 192 6/2005
EP 1 574 432 9/2005
EP 2 060 492 5/2009
EP 2 069 209 6/2009
EP 2 199 214 6/2010
EP 2 792 599 10/2014
FI 78433 4/1989
FI 91624 B 4/1994
FR 1 396 355 4/1965

(56) References Cited

FOREIGN PATENT DOCUMENTS

| | | | |
|---|---|---|---|
| GB | 2 395 165 | | 5/2004 |
| JP | 2002104308 | | 4/2002 |
| JP | 2013154956 | | 8/2013 |
| WO | 02/812065 | | 2/2002 |
| WO | 2004/045952 | | 6/2004 |
| WO | 2006110596 | A1 | 10/2006 |
| WO | 2008031449 | A1 | 3/2008 |
| WO | 2010/078915 | | 7/2010 |
| WO | 2012/027705 | | 3/2012 |

* cited by examiner

METHOD FOR CONVERTING A WRAPPING MACHINE INTO A TRANSPORT CONDITION, AND A WRAPPING MACHINE

RELATED APPLICATIONS

The present application is National Phase of International Application Number PCT/US2012/057067 filed Sep. 25, 2012, and claims priority to Finland Application Number 20115958 filed Sep. 30, 2011.

The invention relates to the conversion of a wrapping machine into a transport condition, said machine using plastic film as a packaging material. More specifically, the invention relates to a method for converting a wrapping machine into a transport condition, in which transport condition the wrapping machine's ring-shaped circular guide for film supply elements is tilted with respect to a horizontal position of the circular guide in its operating condition, thus enabling the wrapping machine space demand to be minimized in its transport condition. The invention also relates to such a wrapping machine.

Previously known are various types of wrapping machines for wrapping a web type plastic film around an article being packaged. The article to be packaged is typically a pallet-mounted load, said load being usually an entity in the form of a rectangular parallelepiped.

In wrapping machines, the plastic film web is wrapped around a load either by rotating rolls of plastic film web around a pallet or by rotating a pallet with respect to rolls of plastic film web, or by conducting both at the same time, whereby the rolls of plastic film web are also simultaneously shifted in vertical direction. Wrapping machines are also typically fitted with elements for providing a piece of film web for covering a top surface of the load to be wrapped.

One way of moving rollers of film web around a stationary pallet and a load thereon is to provide the wrapping machine with a horizontally placed, ring-shaped circular guide, said circular guide being fitted with one or more film supply carriages comprising a roller of film web. Such a circular guide structure can be formed for example from a circular guide ring mounted on a frame of the wrapping machine in a vertically movable manner, and from a circular guide ring capable of rotating relative to the stationary circular guide ring, said rotating circular guide ring being fitted with film supply carriages. Alternatively, the circular guide structure of a wrapping machine may consist of just one circular guide ring, which is mounted on a frame of the wrapping machine either rotatably or non-rotatably, as well as to be movable in vertical direction. One wrapping machine solution based on the use of circular guides is known from patent publication U.S. Pat. No. 4,587,796.

In wrapping machines employing a circular guide, it is the circular guide's diameter which defines pallets compatible with these wrapping machines or maximum horizontal dimensions for a load placed on pallets. Hence, the selection of a circular guide's diameter must be conducted with regard to varying continent-specific standards for pallet sizes. In North America and Asia, for example, the standard pallet sizes are larger than in Europe. Accordingly, wrapping machines to be sold for example to North America and Asia must be equipped with circular guides larger in diameter.

With regard to wrapping machines provided with circular guides, it should also be noted that the ring-shaped circular guide lying in a horizontal plane quite often defines a maximum width of the wrapping machine.

Upon increasing the size of a wrapping machine's circular guide, for example to make it compatible with larger standard-size pallets, the resulting problem will be an increased width of the machine. Regarding for example pallets in the size of 48 inches by 48 inches, which are used in the United States and wherein the nominal basic sizing of a wrapping machine is 50×50 inches, the diameter of a suitable circular guide exceeds the internal width of a conventional ISO freight container (ISO container, defined in standard ISO 668:1995). The delivery of such a machine to a customer in such a container must be conducted by dismantling the machine, thus increasing its reassembling and installation costs. In the event that a wrapping machine is delivered to a customer fully assembled, the delivery costs will become higher because the machine does not fit in a conventional freight container with lower shipping costs.

In a solution according to the present invention, the circular guide of a wrapping machine is attached to a frame of the wrapping machine in such a way that the discussed attachment enables the circular guide to be tilted relative to the frame of the wrapping machine, preferably relative to a longitudinally extending pivot shaft of the wrapping machine, for converting the wrapping machine into a transport condition. Thus the width of a wrapping machine can be minimized with a result that the wrapping machine can be fitted for example in a standard-size ISO shipping container, even with larger circular guide diameters. In addition, the installation of a wrapping machine and its conversion into an operating condition is an easy and quick process, because none of the essential parts or components of the wrapping machine need be removed for transport.

In this context, the circular guide of a wrapping machine refers to a circumferential part, along which or by way of which the plastic film wrapping elements travel around a load being wrapped. It is this circumferential part which typically defines a second largest horizontal dimension of the wrapping machine.

On the other hand, the length of a wrapping machine refers in this context to the largest dimension of a wrapping machine's frame structure.

The solution according to the invention is advantageously applicable to wrapping machines, which are provided with ring-shaped circular guides, and whose circular guide consists of two rings, whereby one, stationary ring of the circular guide is mounted in a vertically movable manner on a frame of the wrapping machine, and the other, movable ring thereof is rotatable along the stationary ring, both rings having the same center axis.

However, it should be noted in this context that, in a solution of the invention, the shape of a circular guide stationary support part is not restricted to the ring. For example in wrapping machines, whose circular guide consists of just one substantially circular ring-shaped part rotatable relative to the frame, it is possible that parts of the guide mountable on the frame can be for example curved sections of circle fixed to the frame, or wheel or roller sets fixed to the frame.

It should further be noted that a solution of the invention can also be implemented by means of a circular guide non-rotatable relative to the wrapping machine frame. In this case, the wrapping machine has its film supply elements advantageously provided with means for conveying the film supply elements along a track formed by the circular guide.

In a solution of the invention, the attachment of a circular guide to the frame of a wrapping machine has been implemented advantageously by way of a connecting part. Hence, the attachment of a circular guide to a wrapping machine can be conducted in a particularly advantageous case in such a way that the attachment of the circular guide to connecting parts comprises connecting points on either side of the circular guide, said connecting points defining a pivot axis for the circular guide, i.e. it is relative to such connecting points that the circular guide is capable of being tilted. In addition, the connecting parts advantageously comprise also disengageable extra connecting points, said extra connecting points providing a means for locking the circular guide in a horizontal plane, i.e. in its operating position.

In a solution of the invention, the circular guide in a transport position is preferably tilted to an angle of about 45-90° with respect to a horizontal plane defined by the operating condition of the wrapping machine.

More specifically, a method of the invention is characterized by what is presented in the characterizing section of claim 1, as well as a wrapping machine of the invention by what is presented in the characterizing section of claim 6.

Figure 2A:
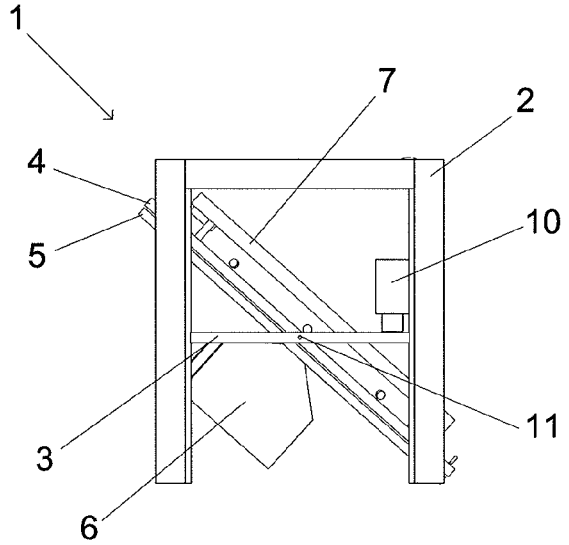
Figure 2B:
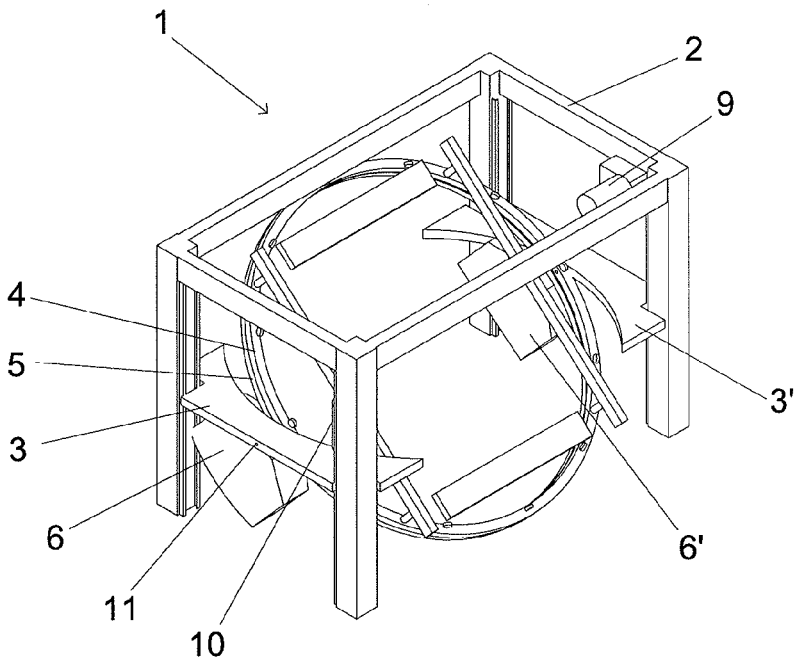
Figure 3A:
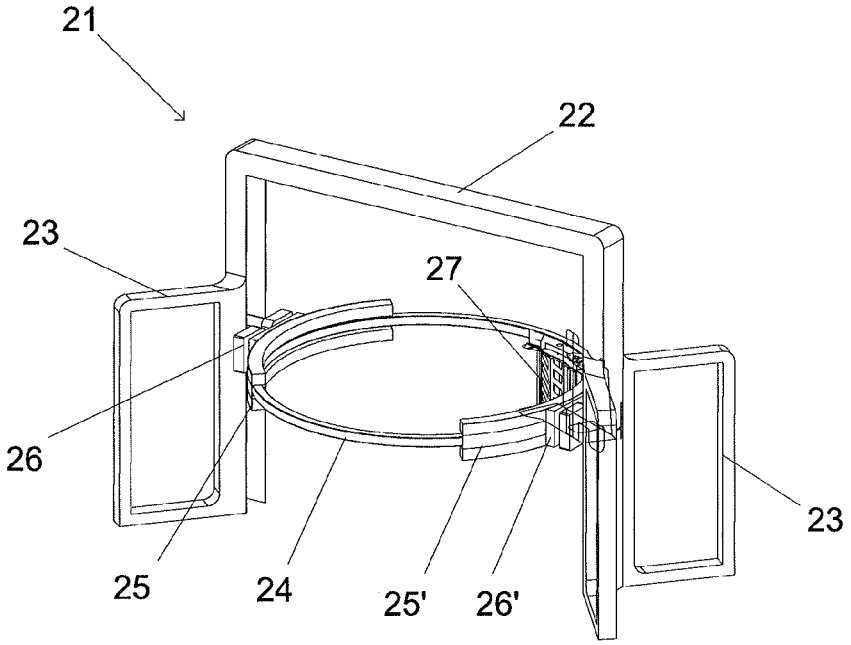
Figure 3B:
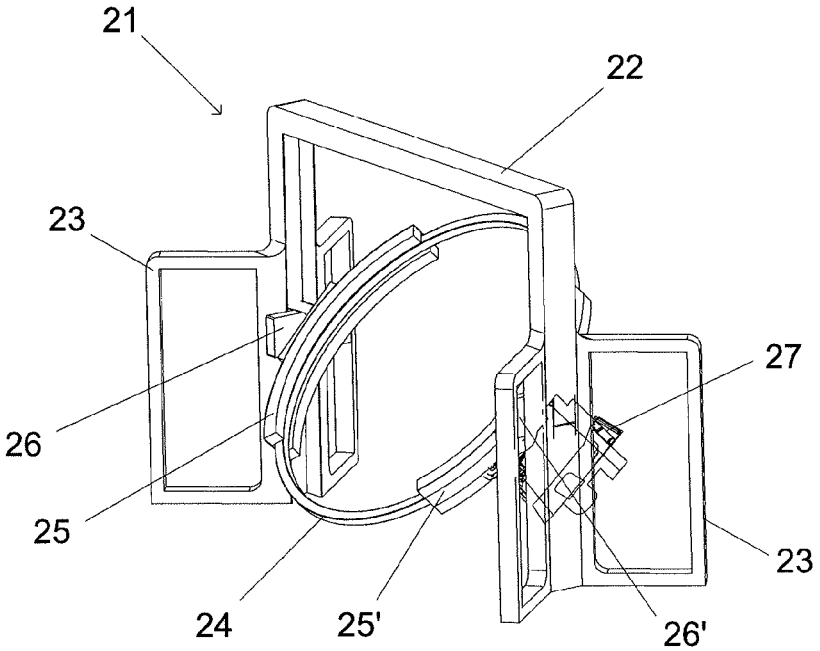
Figure 4:
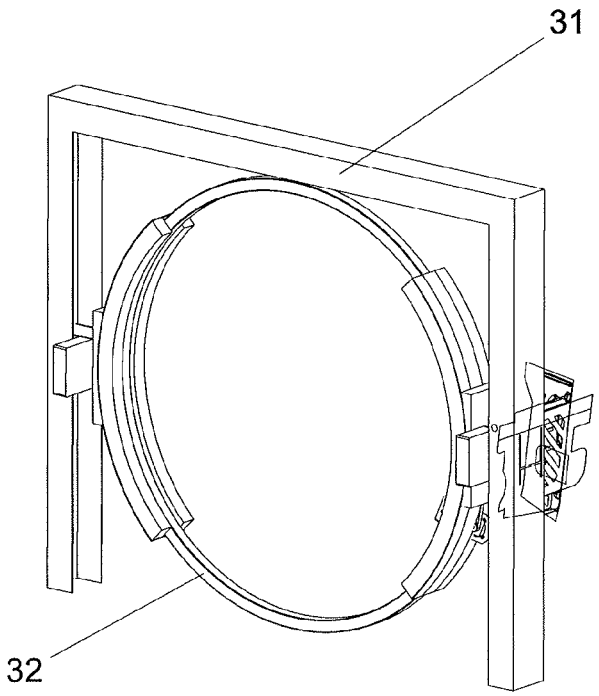

The invention will now be described more precisely by way of example with reference to the accompanying figures, in which FIG. 1 shows schematically one wrapping machine according to the invention in an operating condition three-dimensionally in a view obliquely from above, FIG. 2A shows the wrapping machine of FIG. 1 in a transport condition in a view from end, FIG. 2B shows the wrapping machine of FIG. 1 in a transport condition three-dimensionally in a view obliquely from above, FIG. 3A shows schematically one optional wrapping machine according to the invention in an operating condition, FIG. 3B shows the wrapping machine of FIG. 3A in a transport condition, and FIG. 4 shows schematically a frame structure for one wrapping machine according to the invention in a transport condition.

A wrapping machine 1 according to the invention, which is shown schematically in FIGS. 1, 2A and 2B, comprises a frame 2, a substantially horizontal stationary circular guide 4 movable in a vertical direction of the machine and mounted on the frame by way of connecting parts 3, 3', from which stationary circular guide is suspended by way of rollers a movable circular guide 5 located underneath the stationary circular guide. To the movable circular guide 5 are attached film supply carriages 6 and 6', the number of which is two in the illustrated embodiment and which are placed in mutually opposite positions relative to the movable circular guide. To the stationary circular guide 4 are attached, so as to lie above the circular guide, linear guides 7, 7' for an upper film unit, as well as fastening means 8, 8' for a gripper and cutter of the upper film unit.

The wrapping machine's 1 frame 2 consists of four vertical columns, as well as crossbars securing these vertical columns to each other at top edges thereof, the frame becoming a quadrangle. The frame 2 has the longer sides of its quadrangle, i.e. the longer crossbars, defining a longitudinal direction of the wrapping machine 1, and the shorter sides, i.e. the shorter crossbars, defining a lateral direction of the wrapping machine. The wrapping machine 1 is secured to a solid foundation by the bottom ends of the frame's 2 vertical columns.

In order to move the circular guides 4, 5 in vertical direction, the frame 2 has its vertical columns formed with vertical tracks, along which the connecting parts 3, 3, and therefore the circular guides, are moved in vertical direction with a motor 9. On the other hand, the motion of the movable circular guide 5 is achieved with a rotating motor 10 mounted on one of the connecting parts 3.

When operating the wrapping machine 1, which operating condition is shown in FIG. 1, the load to be wrapped is brought on a pallet inside an area defined by the circular guides 4, 5. This is followed by lowering the circular guides 4, 5 to a starting height around the load, and the ends of film webs located in the film supply carriages 6, 6' are brought into contact with the load and attached to a surface of the load for starting the wrapping process. If necessary, prior to attaching the film webs of the film supply carriages 6, 6' to the load, a plastic film is provided by the upper film unit for covering a top surface of the load. At the start of a wrapping process, the end of a film web can be held for example by a film gripper (not shown), whereby, after a first wrapping cycle, the film gripper releases its grip of the film and the first end of the film is left underneath the following film layers.

Once the ends of film webs are attached to a load to be wrapped, the actual wrapping process is conducted by rotating the film supply carriages 6, 6' around the load being wrapped by rotating the movable circular guide 5, while the circular guide 5 is simultaneously moved also in vertical direction. The wrapping process is continued until a predetermined amount of film web has become wrapped around the load. The amount of film web to be wrapped varies from case to case, nor is the entire load necessarily always wrapped in a film web. The wrapping process is terminated by cutting the film web and by attaching the end of the wrapped film web to a surface of the load. Finally, the circular guides 4, 5 are lifted to a top position and the load is removed from the wrapping apparatus. In connection with cutting the film web, the above-mentioned film gripper takes hold of the film web end remaining in the wrapping machine, whereby the wrapping machine is ready to start wrapping the next load.

In the wrapping machine 1 embodiment of FIGS. 1, 2A and 2B, the attachment of the stationary circular guide 4 to the connecting parts 3, 3' for converting the machine into a transport condition shown in FIGS. 2A and 2B has been implemented in such a way that each connecting part has its mid-portion fitted with a pivot shaft 11, said pivot shaft connecting the stationary circular guide 4 to the connecting part in a pivotable manner. In addition, the circular guide 4 is secured at two connecting points located on either side of the pivot shaft 11 to the connecting points when the circular guides 4, 5 are in an operating condition, whereby the attachments of the connecting points are disengaged for releasing the circular guides for tilting.

In the transport position shown in FIGS. 2A and 2B, the wrapping machine 1 has its circular guides 4, 5 attached in a disengageable and suitable manner for example to a crossbar of the frame 2 for retaining a tilted position.

The circular guides 4, 5 in a transport position have a tilt angle of preferably about 45° relative to horizontal plane.

With regard to the illustrated embodiment, it is also to be noted that this embodiment enables the wrapping machine 1 to be installed, for example in connection with a conveyor line, such that the loaded pallets are brought to the wrapping machine in a longitudinal direction of the wrapping machine for a wrapping process. Such a longitudinally effected installation along the line reduces the space demand of a wrapping machine in lateral direction, the widest part of the wrapping machine 1 being constituted by the film supply carriages 6, 6' attached to the movable circular guide 5 during rotation of the same along the circular guide. Hence, this longitudinal installation of the wrapping machine 1 enables more efficient space utilization.

In FIGS. 3A and 3B is schematically shown one optional wrapping machine 21 according to the invention. In this embodiment, the wrapping machine 21 consists of a simplified frame 22, a frame supporting structure 23, a circular guide 24 in the form of a ring, supporting parts 25, 25' for the circular guide, connecting parts 26, 26' attaching the circular guide supporting parts to the frame, as well as a film supply carriage 27.

In this embodiment, the circular guide 24 only comprises a single piece in the form of a ring, which is rotated in a horizontal plane by the action of the circular guide supporting parts 25, 25'. Rotating the circular guide 24 enables the film supply carriage 27 mounted on the circular guide to be set in rotation around a load to be wrapped and placed inside the circular guide. A vertical movement of the circular guide 24 is effected with actuators (not shown) moving the connecting parts 26, 26' along vertical members of the frame 22.

A tilting capability of the circular guide 24, shown in FIG. 3B, with respect to the frame 22 of the wrapping machine 21 for converting the wrapping machine into a transport condition has been achieved in this embodiment with a two-piece structure of the connecting parts 26, 26'. Hence, the pieces of the connecting parts 26, 26', which attach to the supporting parts 25, 25' of the circular guide 24, are pivotable with respect to the pieces of the connecting parts, which attach to the frame 22 of the wrapping machine 21, about a pivot axis extending lengthwise of the frame 22.

In the embodiment of FIGS. 3A and 3B, the locking of the circular guide 24 to an operating position by using the two-piece connecting parts 26, 26' and disengaging/releasing the locking for tilting the circular guide to a transport position is achievable in a simple manner obvious for a skilled person. Neither does this embodiment necessarily call for any other actions besides tilting the circular guide 24 for converting the wrapping machine 21 into a transport condition, whereby setting up the wrapping machine on its working site is a highly simple and expedient process.

In FIG. 4 is schematically shown one wrapping machine frame structure 31 according to the invention, wherein a circular guide 32 has been pivoted for a transport condition into a parallel relationship with a plane defined by the frame structure, i.e. pivoted to an angle of 90° with respect to a horizontal plane defined by an operating position of the circular guide. The attachment of the circular guide 32 to the frame 31 and the tilting ability of the circular guide relative to the frame have been accomplished in this embodiment with elements according to the embodiment of FIGS. 3A and 3B.

This type of most advantageous and most compact transport position is possible with such wrapping machines, the size of whose circular guide 32 is such that it fits in its entirety within an area defined by the wrapping machine frame 31.

The circular guides presented in the preceding embodiments are rotatable relative to the wrapping machine frame during operation, whereby the movement of film supply carriages or elements mounted on the circular guide is effected on the basis of a movement of the circular guide. However, in a solution of the invention, the circular guide can be constructed in such a way that, with the exception of a vertical movement, the circular guide itself is stationary with respect to the wrapping machine frame. In this case, the film supply carriage is provided with elements by means of which the carriage is able to move independently along a track formed by the circular guide. In a solution such as this, the attachment of a circular guide to the frame of a wrapping machine is generally simpler, whereby the tilting ability of a circular guide with respect to the frame of a wrapping machine is more easily achieved.

Regarding the embodiments shown in the figures and described above, it should be noted that those are by no means intended to limit the invention, but only as examples to clarify the invention. The scope of protection for the invention is solely defined by the appended claims, so the invention can be modified from the preceding embodiments as obvious for a skilled artisan within the scope of protection defined by the claims.

The invention claimed is:

1. A method for converting a wrapping machine from an operating position into a transport position, said wrapping machine comprising a wrapping machine frame having a first side and a second side opposite the first side and a circular guide pivotably connected to the frame via a first connecting part and an opposing second connecting part, said method comprising:

providing the wrapping machine in the operating position, wherein in the operating position the first connecting part and the second connecting part are between the first and second sides of the frame; and when the wrapping machine is in the operating position in which a first portion of the circular guide extends outside of the first side of the frame and a second portion of the circular guide extends outside of the second side of the frame, pivoting the circular guide relative to the wrapping machine frame about a pivot axis to the transport position in which part of the first portion of the circular guide and part of the second portion of the circular guide are between the first and second sides of the frame, the pivot axis extending between the first and second connecting parts and through an area bound by the circular guide.

2. The method of claim 1, wherein the wrapping machine includes attachment components configured to lock the circular guide in a horizontal orientation when the circular guide is in the operating position, the method including unlocking the attachment components before pivoting the circular guide.

3. The method of claim 2, wherein the attachment components are configured to lock the circular guide to at least one pivot shaft about which the circular guide is pivotable to secure the circular guide in the operating position, the method including unlocking the circular guide from the at least one pivot shaft before pivoting the circular guide.

4. The method of claim 1, which includes pivoting the circular guide relative to the wrapping machine frame about the pivot axis until the circular guide is angled about 45 degrees to about 90 degrees relative to a horizontal plane.

5. The method of claim 1, wherein the wrapping machine further includes a first pivot shaft and an opposing second pivot shaft, the first pivot shaft connected to the first connecting part and the second pivot shaft connected to the second connecting part.

6. The method of claim 5, wherein the first pivot shaft is connected to the first connecting part at a midpoint of the first connecting part and the second pivot shaft is connected to the second connecting part at a midpoint of the second connecting part.

7. The method of claim 5, wherein the pivot axis extends between the pivot shafts.

8. The method of claim 1, wherein the pivot axis extends across a diameter of the area bound by the circular guide.

9. The method of claim 1, wherein when the circular guide is in the transport position, all of the first portion of the circular guide is between the first and second sides of the frame and all of the second portion of the circular guide is between the first and second sides of the frame.

10. The method of claim 1, further comprising wrapping a load positioned in an area defined by the circular guide by rotating the circular guide while simultaneously moving the circular guide in a vertical direction.

11. A wrapping machine comprising:

a frame having a first side and a second side opposite the first side, a first connecting part supported by the frame;

an opposing second connecting part supported by the frame;

a circular guide pivotably mounted to the first and second connecting parts so the circular guide is pivotable relative to the frame and about a pivot axis between an operating position and a transport position, wherein the pivot axis extends between the first and second connecting parts and through an area bound by the circular guide; and elements connected to the circular guide and configured to wrap a plastic film web around a load placed within the area bound by the circular guide, wherein when the circular guide is in the operating position: (i) the first connecting part and the second connecting part are between the first and second sides of the frame; and (ii) a first portion of the circular guide extends outside of the first side of the frame and a second portion of the circular guide extends outside of the second side of the frame, and wherein when the circular guide is in the transport position, part of the first portion of the circular guide and part of the second portion of the circular guide are between the first and second sides of the frame.

12. The wrapping machine of claim 11, which includes attachment components configured to lock the circular guide in the operating position.

13. The wrapping machine of claim 12, wherein the attachment components are configured to lock the circular guide to at least one pivot shaft about which the circular guide is pivotable to secure the circular guide in the operating position.

14. The wrapping machine of claim 11, wherein the circular guide is pivotable relative to the wrapping machine frame about the pivot axis between a horizontal orientation and an angle about 45 degrees to about 90 degrees relative to a horizontal plane.

15. The wrapping machine of claim 11, which includes a first pivot shaft and an opposing second pivot shaft, the first pivot shaft connected to the first connecting part and the second pivot shaft connected to the second connecting part.

16. The wrapping machine of claim 15, where the first pivot shaft is connected to the first connecting part at a midpoint of the first connecting part and the second pivot shaft is connected to the second connecting part at a midpoint of the second connecting part.

17. The wrapping machine of claim 16, wherein the pivot axis extends between the pivot shafts.

18. The wrapping machine of claim 11, wherein when the circular guide is in the transport position, all of the first portion of the circular guide is between the first and second sides of the frame and all of the second portion of the circular guide is between the first and second sides of the frame.

* * * * *